US006347024B1

(12) United States Patent
Blain et al.

(10) Patent No.: US 6,347,024 B1
(45) Date of Patent: Feb. 12, 2002

(54) HYBRID POWER RELAY

(75) Inventors: Gérard Blain, Chabeuil; Luc Raffestin, Valence, both of (FR)

(73) Assignee: Crouzet Automatismes, Valence (FR)

( * ) Notice: Subject to any disclaimer, the term of this patent is extended or adjusted under 35 U.S.C. 154(b) by 0 days.

(21) Appl. No.: 09/581,225

(22) PCT Filed: Dec. 23, 1998

(86) PCT No.: PCT/FR98/02851

§ 371 Date: Jun. 23, 2000

§ 102(e) Date: Jun. 23, 2000

(87) PCT Pub. No.: WO99/34382

PCT Pub. Date: Jul. 8, 1999

(30) Foreign Application Priority Data

Dec. 23, 1997 (FR) ..... 97 16344

(51) Int. Cl.[7] ..... H01H 33/59
(52) U.S. Cl. ..... 361/3; 361/13
(58) Field of Search ..... 361/2, 3, 7, 8, 361/13, 115, 160, 170, 187, 189, 190, 196

(56) References Cited

U.S. PATENT DOCUMENTS 4,074,333 A * 2/1978 Murakami et al. ..... 361/13
5,528,443 A * 6/1996 Itoga et al. ..... 361/8
5,790,354 A * 8/1998 Altiti et al. ..... 361/8

* cited by examiner

*Primary Examiner*—Kim Huynh
(74) *Attorney, Agent, or Firm*—Oblon, Spivak, McClelland, Maier & Neustadt, P.C.

(57) ABSTRACT

Hybrid power relay used for opening or closing electrical circuits, including an electrical contact having a mechanical movement, a semiconductor component in parallel with the electrical contact, and a control unit which in response to a logic input level causes the electrical contact to close (open) and the semiconductor component to be turned on. The control unit generates a contact-make signal for closing the contact, and a control signal that turn on the semiconductor component for a predetermined period of time. The control signal prevents the semiconductor component from being turned on after the predetermined period if the electrical contact fails to close so that the semiconductor component is undamaged. Also, the control unit generates a contact-break signal for opening the electrical contact, and turning on the semiconductor component before the electrical contact has opened by means of a control signal which terminates at the end of a second predetermined period after the electrical contact has opened.

14 Claims, 3 Drawing Sheets

Ue
Vm
V
E1
S1
S2
80
70
T
t0
t1
t2
t3
t4
t5
t6
t7
Z1
Z2
u1
u2
-u2
-u1

HYBRID POWER RELAY

BACKGROUND OF THE INVENTION

1. Field of the Invention

The invention relates to hybrid power relays used for opening or closing electrical circuits.

2. Discussion of the Background

At the present time there are two main types of relays according to their operating technologies—electromechanical relays and semiconductor or static relays.

The relays are designed to withstand the current of the electrical circuit into they are inserted and to cut off the electrical circuit under load, that is to say when an electric current flows through the circuit.

Electromechanical-type relays comprise one or more electrical contacts having a mechanical movement, these being coupled to a moveable element of the magnetic circuit of an electromagnet. The electromagnet is actuated by supplying power to its coil, which produces an induction flux in the magnetic circuit which causes the moveable element to move and the electrical contacts of the relay to open or close.

The switching of an electrical circuit under load by an electromechanical relay, and particularly when the circuit is inductive, produces arcs between the contacts at the moment the circuit is opened or closed. This phenomenon is usually called sparking.

Sparking causes carbon to form between the contacts (carbonization) due to the combustion of dust or particles of matter when the arc occurs. One consequence of the carbonizing is the degradation in the quality of the contact owing to the increase in the resistance to the flow of current.

Unlike electromechanical relays, static relays do not use moveable mechanical elements but semiconductor components capable of opening or closing an electrical circuit into which they are inserted. Static relays use semiconductor components such as triacs, thyristors, transistors, MOS-thyristors known as insulated-gate controlled thyristors or IGCTs, insulated-gate bipolar transistors or IGBTs and MOS controlled thyristors or MCTs.

These types of semiconductor components have two power inputs intended to be connected to an electrical circuit and one control input which switches the semiconductor component, when it is inserted into the electrical circuit via its two power inputs, either into an off state or into an on state between these two power inputs. In the off state, the entire voltage of the electrical circuit is applied to the power inputs of the semiconductor component and in the on state the current of the electrical circuit into which the semiconductor is inserted flows through the latter.

However, static relays have a drawback compared with electromechanical relays. This is because, in the on state (or saturated state), the semiconductor component has, between its power inputs, when the current flows, a residual saturation voltage which dissipates thermal energy in the semiconductor component and raises its temperature. In a triac for example, this residual saturation voltage is about 1.5 volts. Consequently, static power relays must be used in conjunction with heat sinks in order to remove the heat energy dissipated by the semiconductor component and thus to ensure that they have a sufficient lifetime.

In another type of relay, commonly called a hybrid relay, the semiconductor component is connected in parallel with the mechanical-movement electrical contact of the electromechanical relay. Actuation of the hybrid relay simultaneously causes the semiconductor component to be turned on, which component absorbs the switching arc, and causes the contact of the relay to close, which short-circuits the semiconductor component. Since the contact has a very low resistance, the current of the electrical circuit flows through the contact and not through the semiconductor component, which is de-energized, thus preventing it from heating up. However, this solution has drawbacks, namely that an increase in the resistance between the contacts of the relay, due to various phenomena such as, for example, carbonizing, oxidation, ageing or a mechanical defect of the contacts, causes the appearance, between the contacts, of a voltage drop which may be high enough to energize the semiconductor component in parallel with the contact and to make some, to see practically all, of the current of the electrical circuit flow permanently through the semiconductor component, which in turn causes its heat-up or indeed its destruction if it is not equipped with a heat sink.

SUMMARY OF THE INVENTION

The present invention makes it possible to mitigate the drawbacks of the prior art by providing a hybrid power relay intended to be inserted into an electrical circuit, the hybrid relay comprising an electrical contact having a mechanical movement, a semiconductor component in parallel with the electrical contact having a mechanical movement, control means which cause, on the one hand, the contact to close and turn on the semiconductor component in response to a first control signal and which cause, on the other hand, the contact to open and turn on the semiconductor component in response to a second control signal, characterized in that the control means comprise means:

- for generating, on the basis of the first control signal, a contact-make signal;
- for generating, on the basis of the first control signal, independently of the make signal, a first signal for turning on the component, starting before the contact has closed and terminating after it has closed;
- for generating, on the basis of the second control signal, a contact-break signal;
- for generating, on the basis of the second control signal, independently of the break signal, a second signal for turning on the component, starting before the contact has opened and terminating after it has opened.

The hybrid relay according to the invention can operate with any power component, namely triacs, thyristors, but also transistors, IGBTs, IGCTs and MCTs.

The hybrid power relay is produced so as to generate, on the basis of the first relay control signal, the contact-make signal and the first signal for turning on the component, independently of each other, thereby making it possible to turn on the semiconductor component either simultaneously with the contact-make signal or before the contact-make signal. The same applies when opening the contact. One advantage stemming from this functionality is that the reaction time of the mechanical contact, either upon the appearance of the make signal or upon the appearance of the break signal, does not come into play. This is because, in the case of a relay having a rapid response time, the turn-on of the semiconductor component may be triggered upon closure of the contact, before this closure and upon opening of the contact, before this opening, thereby ensuring sufficient time to establish the current in the semiconductor and thus either open or close the contact with an almost zero current.

In the case of a relay having a response time long enough for the current in the semiconductor to be established, the semiconductor component turn-on signal may be transmitted simultaneously with either the relay contact-make signal or the relay contact-break signal.

The hybrid power relay according to the invention ensures synchronized switching between the electrical contact having a mechanical movement and the semiconductor component in parallel with the contact. This synchronization eliminates practically the entire electric arc that can occur when the electrical contact opens or closes. This is because the contact is opened or closed only when the semiconductor component has been put into the on state.

The hybrid power relay according to the invention has the advantage of making it unnecessary to use a heat sink for the semiconductor component, thereby reducing the cost and the size of the hybrid relay.

In fact, after the contact has closed, the stoppage of the first signal for turning on the semiconductor component prevents the latter from being able to be energized by the appearance of a permanent voltage drop at its terminals, due for example to the carbonizing of the contact or to a permanent mechanical fault in the contact, thus preventing the current of the electrical circuit from flowing into the semiconductor component and protecting it from an abnormal heat-up or indeed from a destruction.

Another advantage of stopping the first signal for turning on the semiconductor component, putting it into the off state, after the contact has closed, stems from the fact of forcing the current of the electrical circuit to flow through the contact, thereby cleaning the contact by destroying the particles of carbonized matter due to the carbonizing.

BRIEF DESCRIPTION OF THE DRAWINGS

Further features and advantages of the invention will appear upon reading the description of examples of relays in which.

DESCRIPTION 0F THE PREFERRED EMBODIMENTS

Figure 1:
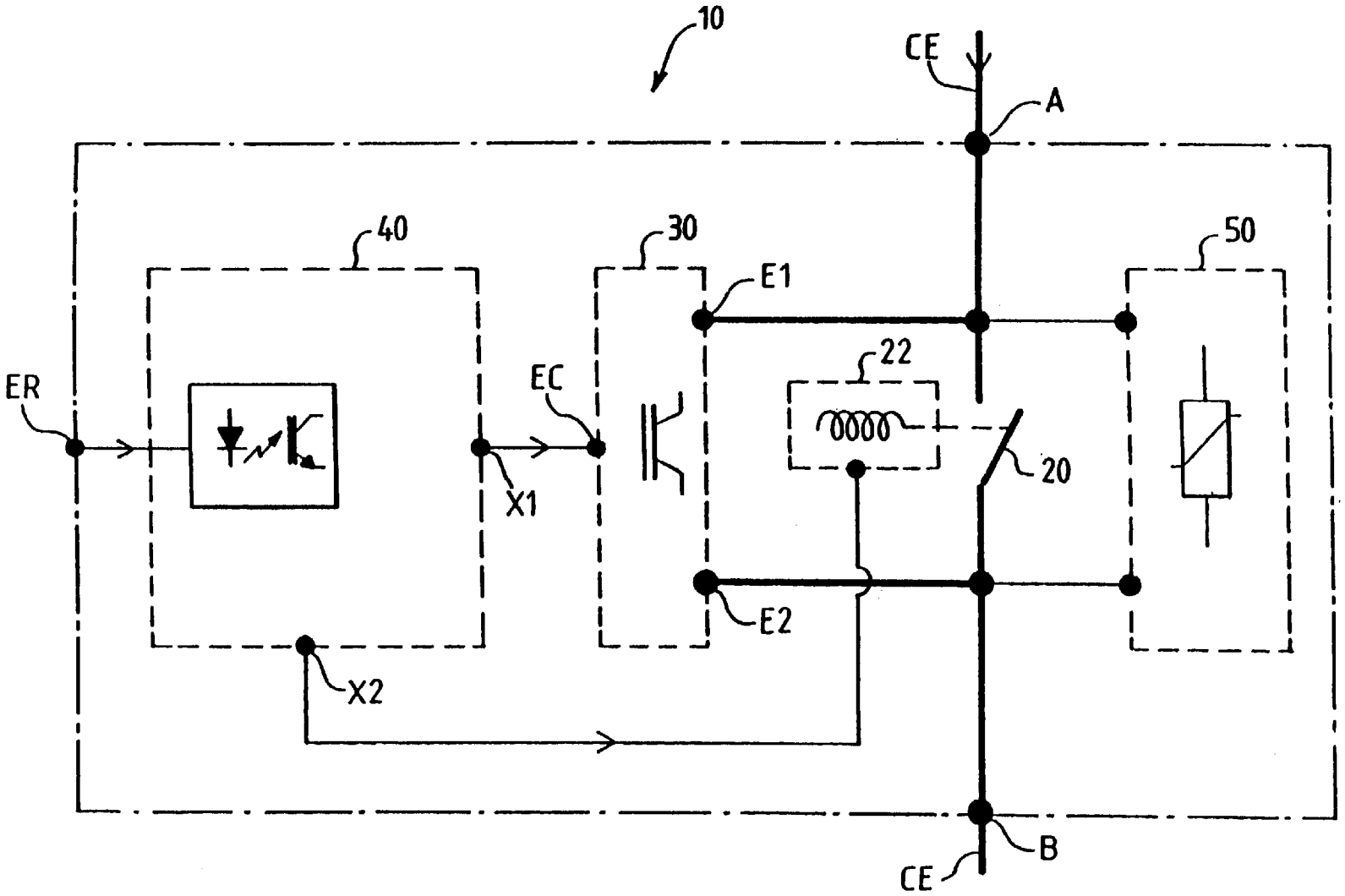
FIG. 1 shows a block diagram of a hybrid power relay according to the invention.

A hybrid power relay 10 has two terminals A and B intended to be inserted into an electrical circuit CE. The hybrid relay is opened or closed by a control input ER of the hybrid relay 10.

The hybrid relay 10 essentially comprises:

an electrical contact 20 having a mechanical movement, connected between the two terminals A and B of the hybrid relay;

a coil 22 which actuates the contact 20 so as to close it or open it;

a semiconductor component 30 having two power inputs E1 and E2, which is connected in parallel with the contact 20 via these two power inputs, and a control input EC for turning it on.

Control means include a control circuit 40 having the control input ER of the hybrid relay, a first output X1 which is fed to the control input EC of the semiconductor component 30, and a second output X2 supplying the coil 22.

The hybrid power relay 10 may furthermore include a protection device 50 connected between the terminals A and B so as to protect the hybrid relay from possible overvoltages that might appear on the electrical mains CE.

The semiconductor component 30 may be chosen from triacs, thyristors, transistors, IGBTs, IGCTs and MCTs and may be combined with one or more semiconductor components of the same type so as to provide the functionality of the hybrid power relay according to the type of electrical circuit into which the hybrid relay is inserted.

For example, two thyristors mounted in parallel, back to back, will be used in an AC circuit.

The hybrid power relay according to the invention has the advantage of ensuring synchronization of the actuation of the contact having a mechanical movement and of the semiconductor component, taking account of requirements associated with the electrical circuit or with the loads connected to the electrical circuit. For example, in the case of an electrical circuit operating under an AC voltage, the control means are configured so as to switch the hybrid relay when the voltage of the electrical circuit passes through a value close to 0 volts.

This is because the closing of the hybrid relay at any instant of the AC voltage period of the electrical circuit, and in particular when this voltage is at the maximum, causes a sudden generation of current in the electrical circuit which may have drawbacks for the equipment connected to the electrical circuit, to see for the electrical circuit itself. We may mention, by way of example, the case of a circuit operating with a 50 Hz AC current having capacitive loads causing a strong current surge when a steep voltage edge is applied to them at the moment of switching the relay.

Figure 2:
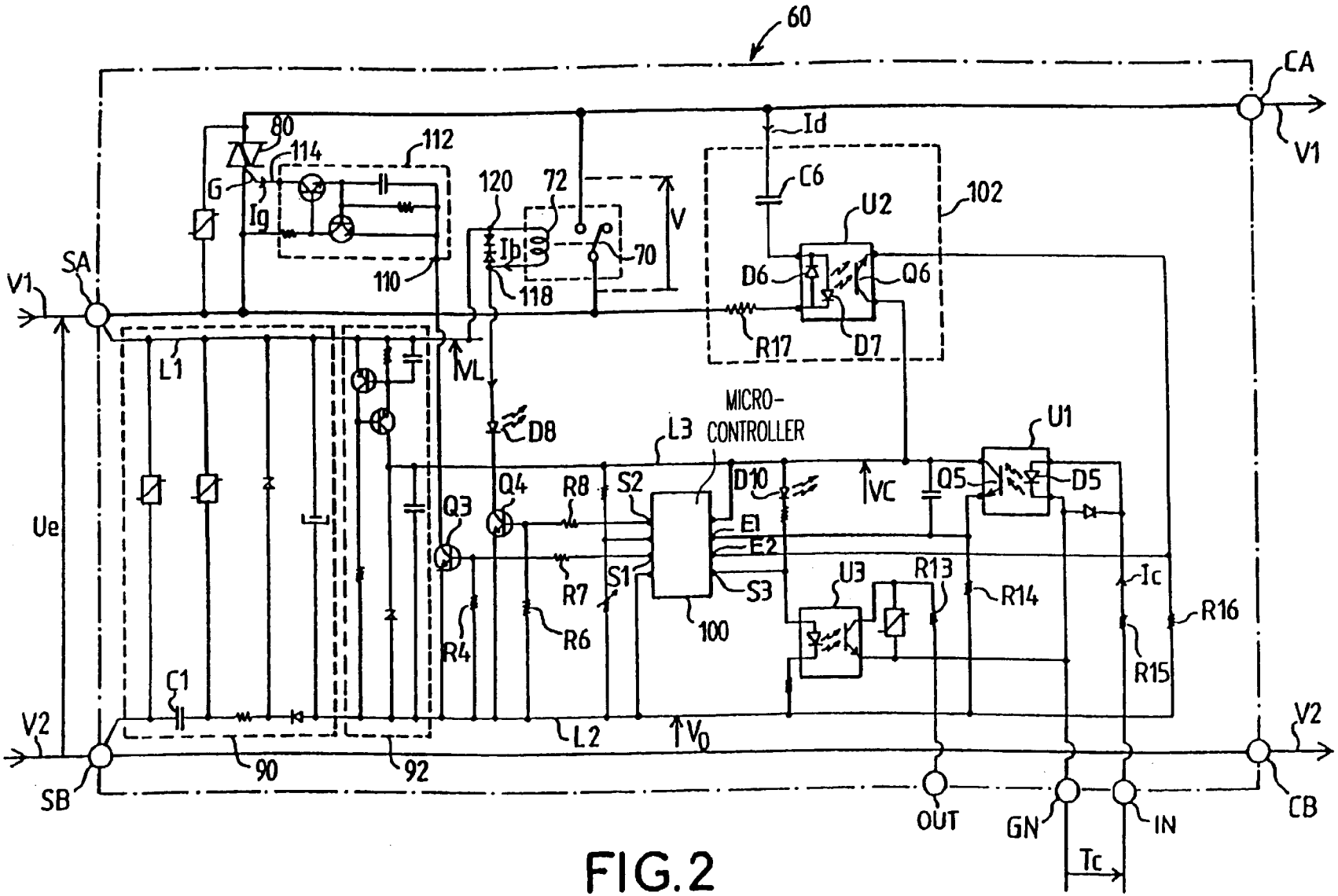
FIG. 2 shows a circuit diagram of an illustrative example of a hybrid power relay according to the invention.

FIG. 2 shows a circuit diagram of a hybrid power relay 60 according to the invention, which uses a triac in parallel with the contact having a mechanical movement and includes control means using a microcontroller.

The microcontroller has the advantage of integrating into the hybrid relay a certain amount of intelligence allowing many parameters associated with the characteristics of the hybrid relay, and with those of the electrical circuit into which the hybrid relay is inserted, to be taken into account.

In the illustrative example in FIG. 2, the hybrid relay 60 is inserted into an AC electrical circuit having two channels, a first channel V1 and a second channel V2 with a voltage Ue between these channels. The channels V1 and V2 supply loads (not shown in FIG. 2).

The hybrid relay 60 is inserted into the first channel V1 via a first input terminal SA, on the same side as the voltage source Ue and via a first output terminal CA on the same side as the loads, respectively, and into the second channel V2 via a second input terminal SB, on the same side as the voltage source Ue, and via a second output terminal CB, on the same side as the loads, respectively.

The hybrid relay 60 includes a contact 70 having a mechanical movement in parallel with a triac 80, the unit formed by the contact 70 in parallel with the triac 80 being inserted into the first channel V1 between the first input terminal SA and the first output terminal CA, the unit opening or closing the first channel V1. The second channel V2 passes without interruption through the hybrid relay, between the second input terminal SB ad the second output terminal CB.

The control means of the hybrid relay are supplied with the voltage Ue of the electrical circuit into which the hybrid relay is inserted by a supply circuit 90 and a regulating circuit 92.

The supply circuit 90 is connected between the channels V1 and V2 of the electrical circuit under the voltage Ue delivering, based on the voltage Ue and through a capacitor C1, the energy necessary for supplying the control means of the hybrid relay. One side of the supply circuit 90 is connected to the first input terminal SA and the other side to the second input terminal SB.

The supply circuit 90 delivers, according to a known arrangement, an approximately constant DC supply voltage VL between a first line L1 and a second line L2. The second line L2 will be regarded as being at a reference potential Vo. The regulating circuit 92 is connected between the first line L1 and the second line L2 under the supply voltage VL and delivers, to a third line L3, a regulated voltage VC with respect to the second line L2 at the reference potential Vo. The voltage VC supplies a microcontroller 100 of the hybrid-relay control means.

The hybrid-relay control means essentially comprise the microcontroller 100 having

- a first logic input E1 receiving an information item for causing the hybrid relay to open (first control signal sent to the input E1) and an information item for causing the hybrid relay to close (second control signal sent to the input E1);
- a second logic input E2 receiving pulses IP from a detection circuit 102 delivering, to the microcontroller 100, information items making it possible to determine, on the one hand, the state of the unit formed by the triac 80 in parallel with the contact 70 and, on the other hand, the moment when the voltage Ue of the electrical circuit passes through a value close to 0 volts. The detection circuit comprises a pair of photodiodes D6 and D7 mounted in parallel, back to back, which are optically coupled to a phototransistor Q6, this pair of photodiodes being in series with a circuit of the RC series type formed by a resistor R17 and a capacitor C6, the pair of photodiodes and the RC circuit being connected in parallel with the unit consisting of the triac 80 in parallel with the contact 70. In this embodiment of the hybrid relay 60, the resistor R17 has a value of approximately 47 ohms and the capacitor C6 has a value of approximately 10 nanofarads;
- a first logic output S1 delivers a first signal for turning on the triac 80 in response to the first control signal (order to close the relay) being applied to the input E1; the output S1 also delivers a second signal for turning on the triac 80 in response to the second control signal (order to open the relay) being applied to the input E1. This output S1 is fed to an input of the control means for turning on the triac 80. These means comprise a first follower transistor Q3 connected via its base, on the one hand, to the first logic output S1 through a base resistor R7 and, on the other hand, to the reference potential Vo through a resistor R4, the emitter of the first follower transistor Q3 being connected to the reference potential Vo and the collector to an input 110 of a trigger current generator 112, an output 114 of the trigger current generator 112 being connected to the trigger G of the triac 80 at the potential of the first channel V1 on the same side as the voltage source Ue;
- a second logic output S2 delivers a contact-make signal (high state on S2) in response to the first control signal appearing on the input E1, and a contact-break signal (low state on S2) in response to the second control signal appearing on the input E1. The output S2 is fed to an input of the supply means for a coil 72 which actuates the contact 70 having a mechanical movement. These means comprise a second follower transistor Q4 connected via its base, on the one hand, to the second logic output S2 through a base resistor R8 and, on the other hand, to the reference potential Vo through a resistor R6, the emitter of the second follower transistor Q4 being connected to the reference potential Vo, and the collector, through a light-emitting diode D8, to a first supply terminal 118 of the coil 72, a second supply terminal 120 of the coil 72 being connected to the first line L1, at the supply voltage VL.

The hybrid relay 60 comprises a control input having two control terminals GN and IN to which is applied a voltage whose level serves to generate the control signals on the input E1 of the microcontroller. Connected between the terminals GN and IN is a resistor R15 in series with a photodiode D5 which is optically coupled to a phototransistor Q5 of a first photocoupler U1. The first photocoupler U1 ensures galvanic isolation between the control input of the hybrid relay and its elements under the voltage Ue of the electrical circuit.

The phototransistor Q5 is connected via its collector to the third line L3 at the regulated voltage VC and via its emitter, on the one hand through a resistor R14, to the second line L2 at the reference potential Vo and, on the other hand, to the first logic input E1 of the microcontroller 100, this first logic input E1 receiving the information item for opening or closing the hybrid relay.

A control voltage Tc applied between the two control terminals GN and IN of the hybrid relay produces a current Ic in the photodiode D5 sufficient to switch on and saturate the phototransistor Q5.

The saturation of the phototransistor Q5 makes its emitter and the first logic input E1 of the microcontroller pass from the reference potential Vo to the regulated voltage VC, corresponding to a change of logic state of the first input E1, which goes from the 0 state to the 1 state. This change of state of the first input E1 is taken into account by the microcontroller which initiates a sequence for closing the hybrid relay 60.

A second photocoupler U2, forming part of the detection circuit 102, generates logic level pulses IP applied to the second logic input E2 of the microcontroller 100. These logic level pulses enable the microcontroller to determine, on the one hand, the change in polarity of the voltage Ue of the electrical circuit (transition through a voltage Ue close to 0 volts) and, on the other hand, the state of the unit formed by the contact 70 in parallel with the triac 80.

For this purpose, the photocoupler U2 comprises the pair of photodiodes D6 and D7 mounted in parallel, back to back, which are optically coupled to the phototransistor Q5, one side of the pair of photodiodes being connected through a capacitor C6 to the first channel V1, on the same side as the first output terminal CA of the hybrid relay, the other side of the pair being connected through a resistor R17 to the first channel V1 on the same side as the first input terminal SA of the hybrid relay. A voltage V appearing across the terminals of the unit formed by the contact 70 in parallel with the triac 80 is applied to the detection circuit 102.

The phototransistor Q6 is controlled, on the one hand, by one of the photodiodes of the pair of photodiodes D6 and D7, during one of the two half-cycles of the voltage V, and, on the other hand, by the other photodiode of the said pair D6 and D7, during the other half-cycle of the voltage V.

The phototransistor Q6 is connected via its collector to the third line L3 at the regulated voltage VC, and via its emitter, on the one hand, to the second line L2 at the reference potential Vo through a resistor R16, and, on the other hand, to the second logic input E2 of the microcontroller 100.

When the phototransistor Q6 is saturated, the voltage applied to the second input E2 is approximately equal to the regulated voltage VC (state 1) and when the phototransistor Q6 is off, it is approximately equal to the reference potential Vo (state 0).

When the hybrid relay is not in operation, the contact 70 is open and the triac 80 is in the off state. Since the first channel V1 of the electrical circuit is interrupted by the hybrid relay, the voltage V is approximately equal to the voltage Ue of the electrical circuit, producing a current Id in the detection circuit 102. The current Id turns on the photodiodes D6 and D7, respectively during one half-cycle of the voltage V and during the other, except for a short period of time corresponding to the transition through a voltage maximum Vm. This is because the current in the capacitor C6 becomes zero when the derivative of the voltage V passes through 0, i.e. when the voltage V stops increasing, by passing through a maximum voltage Vm so as to decrease.

For a short time at the transition through the maximum voltage Vm, the two photodiodes D6 and D7 are off and the phototransistor Q6 is off, producing a pulse Im on the second logic input E2 of the microcontroller, the voltage of which passes from a voltage approximately equal to the regulated voltage VC to a voltage close to the reference potential Vo, so as to return to the regulated voltage VC, this being so at each half-cycle as long as the hybrid relay is open.

Upon a demand to close the hybrid relay at a time t0, the microcontroller 100 computes, from the time t0, from a time tm at which the last pulse Im was produced and from the period T of the voltage Ue of the electrical circuit, the time that has to be waited in order to get the triac 80 into the saturated state, at a moment when the voltage Ue is close to 0 volts, thus preventing the appearance of steep switching edges in the electrical circuit.

When the triac 80 is in the on state, the contact 70 still being open, variations in the voltage V appear when the half-cycle changes, these having an amplitude equal to the saturation voltage u1 of the triac 80, of about 1.5 volts.

These variations in voltages V are transmitted by the capacitor C6 of the detection circuit 102, turning on one of the photodiodes of the pair of photodiodes D6 and D7 and the other one, respectively, this time upon the change in half-cycle. The emitter of the phototransistor Q6 transmits these pulses to the second logic input E2 of the microcontroller 100, which pulses will be used by the microcontroller 100 to determine the state of the contact 70.

When the contact 70 is closed, no pulse will be detected by the second photocoupler U2, the voltage V being virtually equal to 0 volts. The phototransistor Q6 is in the off state and the voltage on the second logic input E2 remains constant and approximately equal to the reference potential Vo.

We will now describe below the operation of the hybrid relay 60 of FIG. 2 with reference to FIGS. 3*a*, 3*b*, 3*c*, 3*d*, 3*e*, 3*f* and 3*g* which represent state and voltage diagrams as a function of time t for various elements of the hybrid power relay.

The hybrid relay is used in an electrical circuit of AC voltage Ue at a frequency of 50 hertz. The period T of the alternation is in this example 20 milliseconds.

Figures 3A, 3B, 3C, 3D, 3E, 3F, 3G:
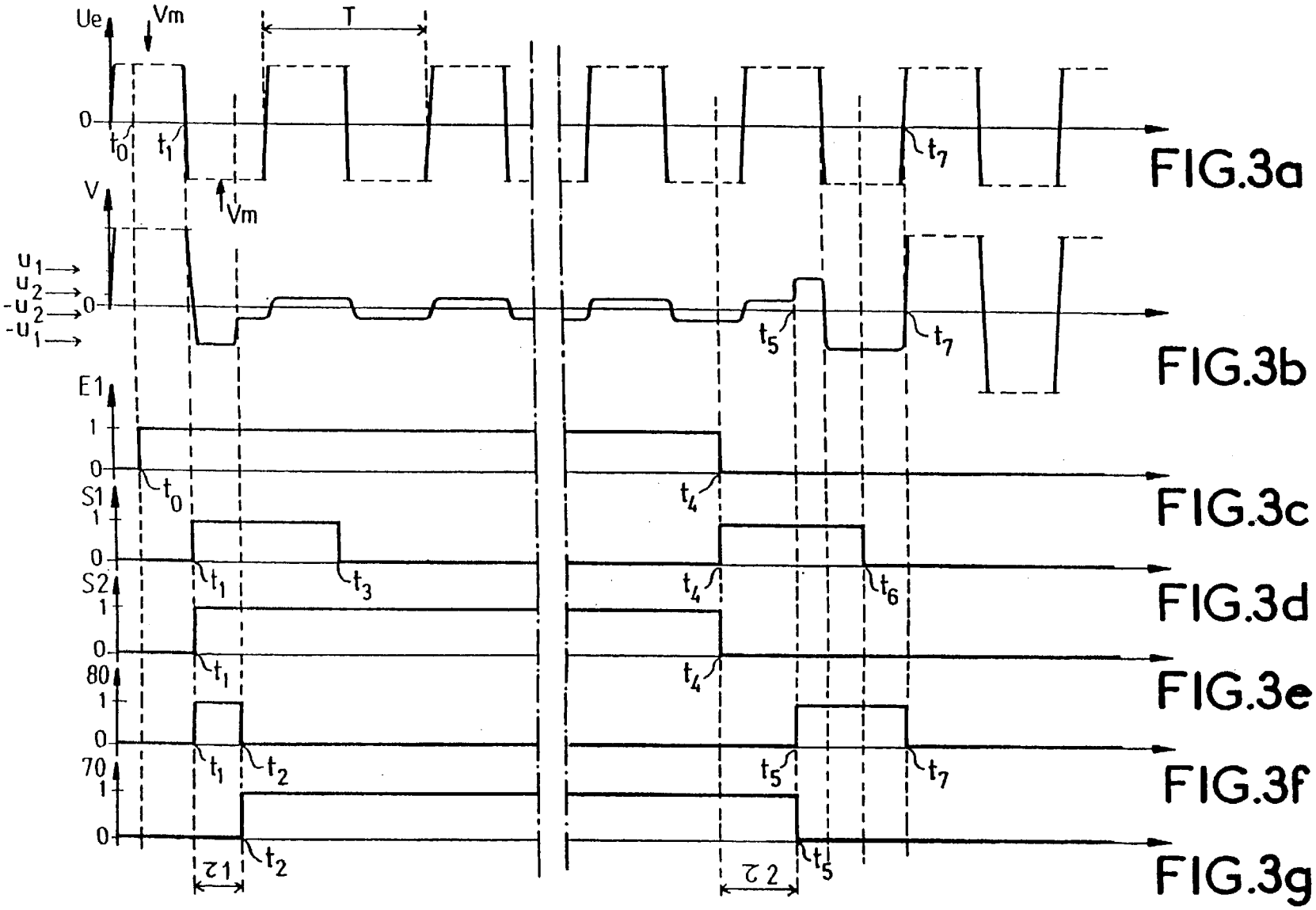
FIGS. 3*a*, 3*b*, 3*c*, 3*d*, 3*e*, 3*f* and 3*g* show diagrams illustrating the operation of the hybrid power relay of FIG. 2.

The diagram in FIG. 3*a* shows the voltage Ue applied to the input terminals SA and SB of the relay between the two channels V1 and V2 as a function of the time t and around a value close to 0 volts when the polarity of the voltage Ue changes.

The diagram in FIG. 3*b* shows the voltage V at the terminals of the unit formed by the contact 70 in parallel with the triac 80, which is inserted into the first channel V1 between the first input terminal SA and the first output terminal SB.

After an initial time t0:

the hybrid relay is at rest and in the open state, the entire voltage Ue of the electrical circuit is applied at the terminals of the contact 70 and of the triac 80 and the voltage V is approximately equal to the voltage Ue;

the current Ic in the photodiode D5 is zero, no control voltage being applied between the control terminals GN and IN of the hybrid relay;

the first logic input E1 of the microcontroller 100 is in the 0 state (see FIG. 3*c*) and the first logic output S1 and the second logic output S2 of the microcontroller 100 are in the 0 state.

At an initial time t0, it is firstly desired to close the hybrid relay 60 by applying the control voltage Tc between the control terminals GN and IN of the hybrid relay. The control current Ic flows through the photodiode D5 which is turned on, saturating the phototransistor Q5 of the first photocoupler U1. Virtually at this time t0, ignoring the response time of the photocoupler U1, the first logic input E1 of the microcontroller switches from the 0 state to the 1 state, being manifested by the appearance of a logic level potential (approximately the regulated voltage VC) applied to this first logic input E1 (see FIG. 3*c*).

In this embodiment of the hybrid relay 60, the microcontroller 100 is programmed to switch the triac 80 to the on state, upon a command to close the hybrid relay, when the voltage Ue of the electrical circuit passes through a level close to 0 volts. Let t1 be the time or the first transition of the voltage Ue through volts (see FIG. 3*a*) after the time t0 initiating the closure of the relay.

At this time t1, the microcontroller 100 switches the first logic output S1 from the 0 state to the 1 state (see FIG. 3*d*) and the second logic output S2 from the 0 state to the 1 state (see FIG. 3*e*).

At the time t1, the transition of the first logic output S1 to the 1 state applies a high logic level potential to the base of the first follower transistor Q3 through the base resistor R7.

At the time t1, the first follower transistor Q3 saturates, putting the input 110 of the current generator 112 at the reference potential Vo, making a current Ig flow via the output 114 of the current generator into the trigger of the triac 80.

At this time t1, the triac at the voltage Ue is energized. This energization is shown by the diagram in FIG. 3*f* showing the triac 80 switching from a 0 state or off state (before t1) to a 1 state or on state at the time t1.

At the same time t1, the second logic output S2 switching to the 1 state applies a high logic level potential through the base resistor R8 to the base of the second follower transistor Q4 which saturates, making a current Ib flow into the coil 72, the supply terminals 118 an 120 of the coil being connected to the supply voltage VL and to the reference potential Vo, respectively.

The diagram in FIG. 3*e* shows the state of the second logic output S2 as well as the state of the supply of the coil 72. Before the time t1, the current Ib in the coil 72 is almost zero, corresponding to a 0 state in the diagram of FIG. 3*e*, and at the time t1 the current Ib goes through the coil 70, corresponding to a 1 state.

The coil 72, being supplied, causes the contact 70 to close after a delay $\tau 1$ corresponding to a closure response time of the contact 70. In general, this delay $\tau 1$ is about 5 ms for series relays. Closure of the contact takes place at the time t2 equal to $t1+\tau 1$.

The closure of the contact 70 at the time t2 is shown by the diagram of FIG. 3*g*, in which an open contact corresponds to a 0 state and a closed contact to a 1 state.

Closure of the contact 72 at the time t2 short-circuits the triac 80, which is then de-energized virtually at the same time t2 and the current of the electrical circuit no longer passes through it. In the diagram of FIG. 3*f*, the triac 80 is shown switching from the 1 state to the 0 state at the time t2.

It is to be pointed out that the closure of the contact 70 at the time t2 took place while the current in the electrical circuit was already established (at the time t1) through the triac 80, hence with no arc for the contact 70.

The microcontroller maintains control of the thyristor trigger current Ig (first logic output S1 in the 1 state) for a safety period (a few milliseconds) until a time t3 at which the first logic output S1 switches from the 1 state to the 0 state, interrupting the trigger current Ig of the triac 80 and thus preventing any energization of the triac 80 in the event of a permanent voltage appearing between its terminals such as, for example, a residual voltage due to the contact 70 being carbonized.

The triac 80 is kept under control in the on state for a first period of time starting before the contact 70 closes, at the time t1, and terminating after it closes, at the time t3.

The diagram of FIG. 3*b* shows the variations in the voltage V at the terminals of the triac 80 in parallel with the contact 72, during this first phase in which the hybrid relay 60 is closed.

Between the times t0 and t1 the entire voltage Ue is applied to the terminals of the triac 80, between the times t1 and t2, the triac being in the on state and the contact being open, and the voltage V is approximately equal to the residual voltage −u1 for conduction of the triac, i.e. approximately −1.5 volts, and after the time t3, the contact 70 short-circuiting the triac 80, the voltage V becomes very small, equal to a residual voltage ±u2 due to the flow of the current through the contact 70. This residual voltage is, for most contacts having a mechanical movement, less than a few millivolts.

At a time t4, during a second phase, it is desired to open the hybrid relay 60. At this time t4, the control voltage Tc is no longer applied to the control terminals GN and IN of the hybrid relay, the current Ic becoming zero, and the photodiode D5 turns off, turning off the phototransistor Q5 which makes the first logic input E1 of the microcontroller switch to the 0 state (see FIG. 3*c*).

At the time t4, the microcontroller 100 makes the first logic output S1 switch to the 1 state, which causes the current Ig to be applied by the current generator 112 to the trigger of the triac 80. The triac 80 remains de-energized because it is short-circuited by the still-closed contact 70.

At the same time t4, the microcontroller 100 makes the second logic output S2 switch to the 0 state, interrupting the supply to the coil 72 and, after a delay τ2 corresponding to the opening response time of the contact 70, of about 10 ms for a series relay, the latter opens at the time t5 equal to t4+τ2, energizing the triac 80 to the on state (FIG. 3*f*).

At the time t5, the current in the first channel V1 is flowing through the energized triac 80, eliminating almost the entire arc at the contact terminals 70.

The microcontroller maintains control of the trigger current Ig of the triac 80 (first output S1 in the 1 state) for a new safety period (a few milliseconds) until a time t6 at which the first logic output S1 switches from the 1 state to the 0 state, interrupting the trigger current Ig of the triac 80.

At a following time t7, corresponding to the first polarity reversal of the voltage Ue after the time t6, the triac 80 is de-energized by the voltage V at its terminals passing through approximately 0 volts. The triac 80, no longer being controlled, thereafter remains in the off state, setting the hybrid relay in the open state as it was before the time t0.

The triac 80 is kept in the on state for a second period of time starting before the contact 70 opens, at the time t4, and terminating after it opens at the time t6.

The diagram of FIG. 3*b* shows the voltage V at the terminals of the triac during this second phase in which the hybrid relay 60 is open.

Before the time t5, with the hybrid relay being in the closed state, the contact 70 short-circuits the triac 80 and the voltage V is equal to the residual voltage u2 of the contact 70.

After the time t5 until the time t7, with the contact 70 being open and the triac 80 in the on state, the voltage V is equal to the residual voltage u1 at the terminals of the triac, i.e. approximately 1.5 volts. After the time t7, with the contact being open and the triac in the off state, the voltage V is approximately equal to the voltage Ue of the electrical circuit.

The microcontroller 100 ensures, with the aid of the detection circuit 102, that the hybrid relay has an additional safety feature.

This is because when the contact 70 is in the closed state, no pulse is applied to the second logic input E2 of the microcontroller, the contact 70 short-circuiting the thyristor 80, which is de-energized and not controlled. An inopportune and transient opening of the relay contact, for example due to a shock or to a manual action on the contact, causes the entire voltage of the electrical circuit to appear at the terminals of the contact 70 at the moment it opens, producing an electric arc, with the known degradation on the contact. This sudden voltage variation at the terminals of the contact 70 is converted into a current variation in the capacitor C6 of the detection circuit 102, producing, by means of the photocoupler U2, a logic level pulse on the second logic input E2 of the microcontroller 100. The microcontroller considers this pulse and makes the first logic output S1 switch to the 1 state for a short period of time during which the contact is open, applying during this same short time the current Ig to the trigger of the triac 80 and turning on the triac, this having the advantage of eliminating the arc occurring on the contact 70.

This additional safety feature ensures that the relay has the greatest reliability and the longest lifetime in situations in which it is used in a disturbed environment.

The hybrid power relay 60 is provided with light-emitting diodes indicating its state.

The light-emitting diode D8 (which is green) indicates, when it is illuminated, that the hybrid relay is closed.

A red light-emitting diode D10, controlled by a third logic output S3 of the microcontroller 100, indicates an abnormal operation of the hybrid relay and the abnormal-operation information item is sent to the outside of the relay via a control terminal OUT galvanically isolated from the elements under voltage Ue of the hybrid relay by a third photocoupler U3.

The embodiment of the hybrid power relay 60 is not limiting and other, simpler versions may be produced using, for example, exclusively discrete components or hard-wired logic elements, a system with a microcontroller making it possible to take into account many parameters associated with the hybrid relay or the type of electrical circuit into which it is inserted.

In other embodiments of the hybrid relay, the contact having a mechanical movement and the coil are contained in a sealed casing filled with a liquid having a high dielectric power. The contact and the coil, which are immersed in the liquid, has the advantage of reducing the acoustic switching noise, of considerably increasing the number of operations of putting the hybrid relay under load, going on average from 100,000 to 10 million operations, and of increasing the performance of the relay from the standpoint of the cut-off capability.

What is claimed is:

1. A hybrid power relay configured to be inserted into an electrical circuit, comprising:

an electrical contact having a mechanical movement;

a semiconductor component disposed in parallel with the electrical contact; and a control unit causing the electrical contact to close and the semiconductor component to turn on in response to a first logic input level, and the electrical contact to open and the semiconductor component to turn on in response to a second logic input level, wherein the control unit generates, a contact-make signal closing the electrical contact on the basis of the first logic input level, a first control signal turning on the semiconductor component on the basis of the first logic input level and independently of the contact-make signal, wherein the first control signal is generated before the electrical contact has closed and is terminated at the end of a first predetermined period after the electrical contact has closed, a contact-break signal opening the electrical contact on the basis of the second logic input level, and a second control signal turning on the semiconductor component on the basis of the second logic input level and independently of the contact-break signal, wherein the second control signal is generated before the electrical contact has opened and is terminated at the end of a second predetermined period after the electrical contact has opened.

2. A hybrid power relay according to claim 1, wherein the first control signal is transmitted simultaneously with the contact-make signal.

3. A hybrid power relay according to claim 1, wherein the first control signal is transmitted before the contact-make signal.

4. A hybrid power relay according to claim 1, wherein the semiconductor component includes:

two power inputs which are connected in parallel with the electrical contact; and a control input for turning the semiconductor component on.

5. A hybrid power relay according to claim 1, wherein the opening or closing of the electrical contact having a mechanical movement is actuated by a coil.

6. A hybrid power relay according to claim 5, wherein the control unit comprises:

a control circuit having a control input of the hybrid relay;

a first output that sends the first control signal to the control input of the semiconductor component; and a second output that sends the second control signal to the coil.

7. A hybrid power relay according to claim 5, wherein the electrical contact and the coil are contained in a sealed casing filled with a liquid having a high dielectric power.

8. A hybrid power relay according to claim 1, wherein the semiconductor component is a triac, thyristor, transistor, IGBT, IGCT or MCT.

9. A hybrid power relay according to claim 1, wherein the semiconductor component is a triac.

10. A hybrid power relay according to claim 1, wherein the control unit is supplied with a voltage of the electrical circuit into which the hybrid relay is inserted.

11. A hybrid power relay according to claim 10, wherein the control unit is configured so as to switch the hybrid relay under a first or second logic input level when the voltage of the electrical circuit passes through a value close to zero volts.

12. A hybrid power relay according to claim 10, further comprising:

a supply circuit connected to the voltage of the electrical circuit and delivering an approximately constant DC supply voltage between a first line and a second line, the second line being considered at a reference potential; and a regulating circuit connected between the first line and the second line and delivering a regulated voltage to a third line with respect to the second line taken as potential reference.

13. A hybrid power relay according to claim 12, wherein the control unit further comprises:

a detection circuit including, a series RC circuit formed by a first resistor and a first capacitor, a first phototransistor, and a pair of photodiodes mounted in parallel, head to tail, said photodiodes being optically coupled to the first phototransistor and connected in series with the series RC circuit, said pair of photodiodes and the series RC circuit being connected in parallel with a triac that is in parallel with the electrical contact; and a microcontroller including, a first logic input receiving the first or the second logic input level causing the hybrid relay to close or open respectively, a second logic input receiving pulses from the detection circuit that delivers a phase signal to the microcontroller, said microcontroller determining based on the phase signal a state of the triac connected in parallel with the electrical contact and an instant when the voltage of the electrical circuit passes through a value close to zero volts, a first logic output which is connected to an input of a control unit for turning on the triac, a second logic output which is connected to an input of a coil supply unit which actuates the electrical contact, a first follower transistor having a base connected to the first logic output through a first base resistor and to the reference potential through a second resistor, an emitter connected to the reference potential, and a collector connected to an input of a trigger current generator, an output of a trigger current generator being connected to a trigger of the triac at a potential of the first line, and a second follower transistor having a base connected to the second logic output through a second base resistor and to the reference potential through a third resistor, an emitter connected to the reference potential, and a collector connected through a light-emitting diode to a first supply terminal of the coil, a second supply terminal of the coil being connected to the first line, at a supply voltage.

14. A hybrid power relay according to claim 13, further comprising a control input unit including:

two control terminals;

a first photocoupler comprising a second phototransistor configured to provide galvanic isolation between the hybrid relay and the electrical circuit;

a photodiode which is optically coupled to the second phototransistor of the first photocoupler, wherein the second phototransistor has a collector connected to the third line at a regulated voltage, and an emitter connected through a fifth resistor to the second line at the reference potential and to the first logic input of the microcontroller, the first logic input receiving the first or second logic input level for opening or closing the hybrid relay; and a fourth resistor connected in series with the photodiode between the two control terminals.

* * * * *